US010297956B2

(12) United States Patent
Abouklassem et al.

(10) Patent No.: US 10,297,956 B2
(45) Date of Patent: May 21, 2019

(54) PLUG CONNECTOR

(71) Applicant: TE Connectivity Germany GmbH, Bensheim (DE)

(72) Inventors: Samir Abouklassem, Darmstadt (DE); Robert Wuerker, Frankfurt am Main (DE); Christian Schrettlinger, Bensheim-Auerbach (DE); Guenther Mumper, Egelsbach (DE); Alfons Ketteler, Darmstadt (DE); Bert Bergner, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/725,387

(22) Filed: Oct. 5, 2017

(65) Prior Publication Data

US 2018/0102611 A1 Apr. 12, 2018

(30) Foreign Application Priority Data

Oct. 7, 2016 (EP) ..... 16192912

(51) Int. Cl.
*H01R 13/648* (2006.01)
*H01R 13/6583* (2011.01)
(Continued)

(52) U.S. Cl.
CPC ..... *H01R 13/6583* (2013.01); *H01R 24/64* (2013.01); *H01R 9/035* (2013.01);
(Continued)

(58) Field of Classification Search
CPC ..... H01R 13/6583; H01R 24/64; H01R 2201/26; H01R 27/00; H01R 9/037; H01R 2201/04; H01R 2107/00; H01R 9/035
(Continued)

(56) References Cited

U.S. PATENT DOCUMENTS 4,655,532 A * 4/1987 Hillis ..... H01R 13/6584 439/607.19
4,936,795 A * 6/1990 Kawai ..... H01R 13/655 439/607.19
(Continued)

FOREIGN PATENT DOCUMENTS

EP 0704940 A2 4/1996
EP 0971442 A1 1/2000
JP 2002280131 A 9/2002

OTHER PUBLICATIONS

DiBiaso, E., Bergner, B., Wuelfing, J., Wuerker, R. et al., "Designing a Connection System for Gigabit Automotive Ethernet," SAE Int. J. Passeng. Cars—Electron. Electr. Syst. 9(1):134-146, 2016, doi:, 10.4271/2016-01-007, vol. 9, Issue 1, May 2016, 13 pages.
(Continued)

*Primary Examiner* — Abdullah A Riyami
*Assistant Examiner* — Nelson R. Burgos-Guntin
(74) *Attorney, Agent, or Firm* — Barley Snyder

(57) ABSTRACT

A plug connector for insertion into a socket comprises a plug connector frame and a spring element. The plug connector frame has a side wall and a front opening receiving a cable head. The spring element is formed of a resilient material and electrically connects the cable head and the socket. The spring element has a first contacting portion projecting inward from the side wall and electrically contacting the cable head and a second contacting portion projecting outward from the side wall and electrically contacting the socket.

21 Claims, 10 Drawing Sheets

(51) Int. Cl.

| | |
|---|---|
| ***H01R 24/64*** | (2011.01) |
| *H01R 107/00* | (2006.01) |
| *H01R 9/03* | (2006.01) |
| *H01R 27/00* | (2006.01) |

(52) U.S. Cl.
CPC ..... *H01R 9/037* (2013.01); *H01R 27/00* (2013.01); *H01R 2107/00* (2013.01); *H01R 2201/04* (2013.01); *H01R 2201/26* (2013.01)

(58) Field of Classification Search
USPC ..... 439/607.19, 98, 607.41, 607.42
See application file for complete search history.

(56) References Cited

U.S. PATENT DOCUMENTS 5,417,590 A * 5/1995 Dechelette ..... H01R 13/64 439/607.48
6,666,719 B1 * 12/2003 Kuroi ..... H01R 9/032 439/607.19
8,439,706 B2 * 5/2013 Sytsma ..... H01R 13/65802 439/607.19
2009/0093170 A1 4/2009 Shinkawa et al.
2011/0250792 A1 * 10/2011 Whiteman, Jr. ..... H01R 9/037 439/607.19
2013/0203291 A1 * 8/2013 Sticker ..... H01R 9/0527 439/607.41
2014/0120768 A1 * 5/2014 Wetzel ..... H01R 13/53 439/607.01
2016/0056550 A1 * 2/2016 Justi ..... H01R 13/6583 439/607.01
2016/0072240 A1 * 3/2016 Fontaine ..... H01R 4/2404 439/397
2017/0250494 A1 * 8/2017 Fontaine ..... H01R 13/514
2018/0102611 A1 * 4/2018 Abouklassem .... H01R 13/6583
2018/0131122 A1 * 5/2018 Fontaine ..... H01R 13/6272

OTHER PUBLICATIONS

European Search Report, dated Mar. 20, 2017, 9 pages.

* cited by examiner

PLUG CONNECTOR

CROSS-REFERENCE TO RELATED APPLICATION

This application claims the benefit of the filing date under 35 U.S.C. § 119(a)-(d) of European Patent Application No. 16192912.0, filed on Oct. 7, 2016.

FIELD OF THE INVENTION

The present invention relates to a plug connector and, more particularly, to a process for producing the plug connector as well as to a system including the plug connector, a socket and a cable head.

BACKGROUND

Recent developments of single twisted pair Ethernet physical layers for 100 Mbit/s and 1 Gbit/s automotive applications allow new data communication architectures capable of accommodating a large number of communication nodes. While unshielded twisted pair (UTP) cabling is the most economical solution for large quantities of Ethernet ports to be deployed, the electromagnetic compatibility (EMC) performance of the UTP is limited. Accordingly, a specific electrical design of all components is necessary for achieving sufficient EMC when using the UTP. TE Connectivity's MATEnet connector platform, for example, addresses those needs and provides an automotive solution for unshielded cabling as described in DiBiaso, E., Bergner, B., Wuelfing, J., Wuerker, R. et al., "*Designing a Connection System for Gigabit Automotive Ethernet,*" *SAE Int. J. Passeng. Cars—Electron. Electr. Syst.* 9(1): 134-146, 2016, doi: 10.4271/2016-01-007.

There are some sensitive Ethernet links in some car platforms, however, where the emitted electromagnetic noise needs additional suppression. For instance, a car with a front facing camera mounted above the rear view mirror may also integrate the AM, FM and digital radio broadcast antennas in the windshield in close proximity to the camera. In this case, the performance of these wireless systems may be degraded by the network camera connection even if a high performance UTP system is used. One possible solution is the use of a fully shielded connector system instead of an unshielded system for the sensitive Ethernet links, however, the use of different connector platforms in the same Ethernet system increases the component variance and typically leads to increased costs. Using a fully shielded system for all Ethernet links is an alternative approach, but is likely to be even more expensive.

SUMMARY

A plug connector for insertion into a socket comprises a plug connector frame and a spring element. The plug connector frame has a side wall and a front opening receiving a cable head. The spring element is formed of a resilient material and electrically connects the cable head and the socket. The spring element has a first contacting portion projecting inward from the side wall and electrically contacting the cable head and a second contacting portion projecting outward from the side wall and electrically contacting the socket.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
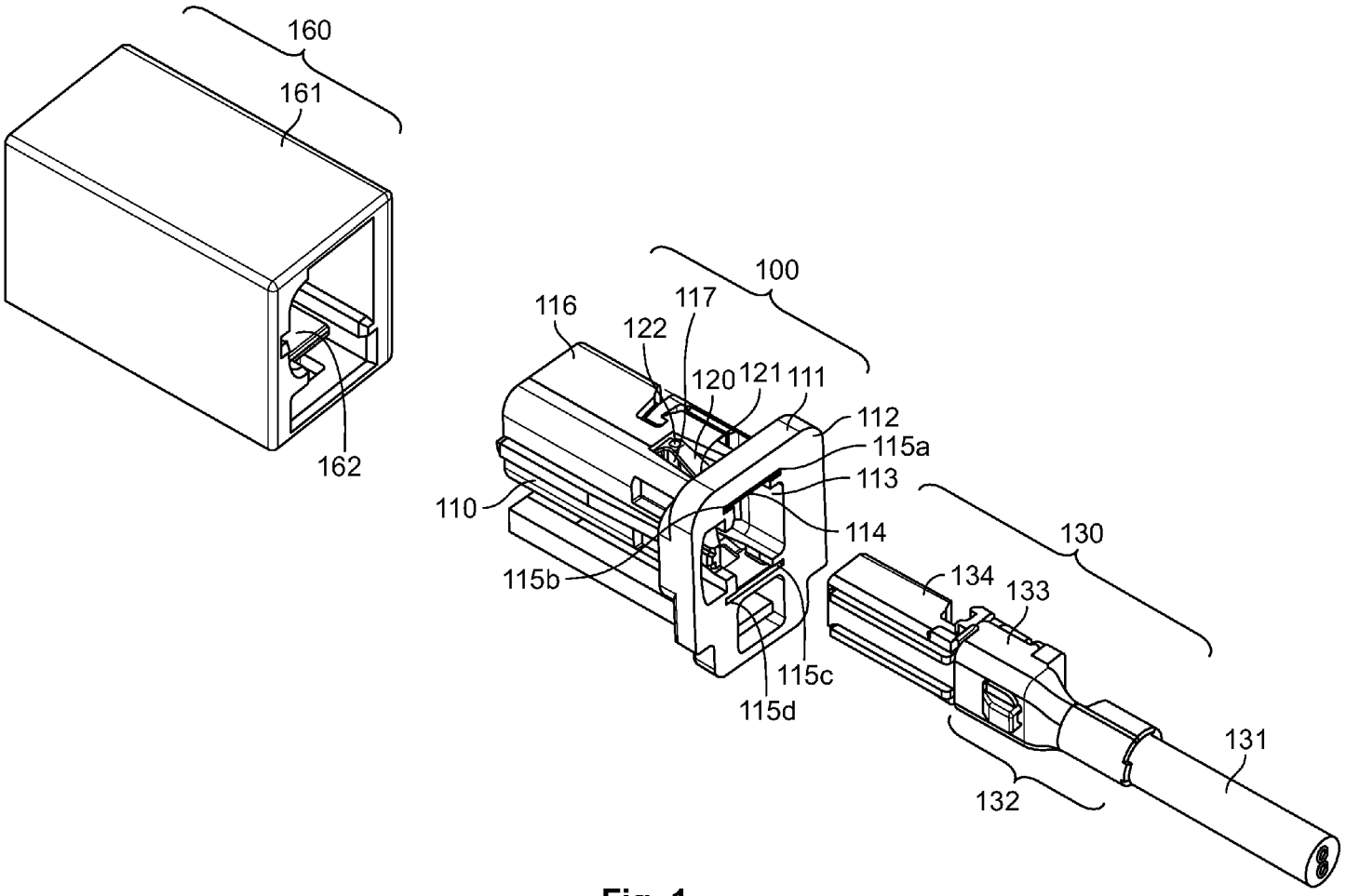
FIG. 1 is an exploded perspective view of a plug connector system according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A plug connector system according to the invention is shown in FIG. 1. The plug connector system comprises a plug connector 100, a cable head 130, and a socket 160.

In the shown embodiment, the socket 160 corresponds to a board connector of the above mentioned MATEnet platform. A plate 162 made of an electrically conductive material such as metal is fitted into the body 161 of the socket 160 as shown in FIG. 1.

The cable head 130 is mounted on a cable 131 as shown in FIG. 1; the cable 131 is thus terminated with a terminal corresponding in shape to the socket 160. The cable head 130 of a shielded cable 130 also has shielding. In the embodiment shown in FIG. 1, the cable head 130 is the cable head of the shielded cable 131, for example a shielded twisted pair (STP) cable. The cable head 130 has a fixation element 132 with a crimp section 133. The fixation element 132 is made of an electrically conductive material such as metal and serves as an electromagnetic shield. The cable head 130 further comprises a contact insert 134 embedding a plurality of contacts for electrically connecting a plurality of wires of the cable 131 with the socket 160. The contact insert 134 is made of plastic. For the purpose of the present invention, the particular form and structure of the cable 131 and cable head 130 is not limiting.

The plug connector 100, as shown in FIG. 1, comprises a plug connector frame 110 and a spring element 120 for electrically connecting the cable head 130 and the socket 160. The plug connector frame 110 has a front face 112 and a side wall 116. In the side wall 116 of the plug connector frame 110, there is a side wall opening 117. In the front face 112 of the plug connector frame, there is a front opening 113 for accommodating the cable head 130 and a gap 114 for inserting the spring element 120. The gap 114 and the side wall opening 117 are joined.

The plug connector frame 110, as shown in FIG. 1, has four side walls 116 with two pairs of opposite side walls 116. Adjacent side walls 116 are perpendicular, and the edges between adjacent side walls 116 are rounded so that the four walls with the rounded edges enclose the front portion 111 of the plug connector 100. In other embodiments, instead of having four side walls 116, the side wall 116 of the plug connector frame may be single round side wall of a cylinder or it may have more or less than four walls with or without rounded edges. In an embodiment in which the plug connector 100 has a cylindrical side wall, the socket 160 and the cable head 130 have a round cross-section.

The gap 114, as shown in FIG. 1, has the shape of two grooves 115*a*, 115*b* embedded into a front portion 111 adjacent to the front face 112. The grooves 115*a*, 115*b* run from the front face 112 to a position where the front portion 111 meets the side wall 116. The grooves 115*a*, 115*b* are located at the edge of the front opening 113; the gap 114 for inserting the spring element 120 and the front opening 113 for accommodating the cable head 130 are joined. The front gap 114 and the front opening 113 form a cavity divided into the front gap 114 and the front opening 113 through a pair of opposite rails at the cavity walls, the gaps delimiting the grooves 115*a*, 115*b*.

The front portion 111, as shown in FIG. 1, is formed as a sleeve which has rounded corners and overhangs the side walls 116 of the frame 110 on all sides. The width of the front portion 111 in FIG. 1 allows for robustly embedding the grooves 115*a*, 115*b* for inserting the spring element 120. Nevertheless, the present invention is not limited thereto and in general, the spring element 120 may be accommodated in any other way. The embodiment of the plug connector 100 shown in FIG. 1 is also merely exemplary. The plug connector 100 does not necessarily include a separate front portion 111 set apart from the remaining portion of the plug connector frame 110.

The side wall opening 117 forms an open space in which a plurality of contacting portions 121, 122 of the spring element 120 emerge in the respective inward and outward directions above the side wall 116. In an alternative embodiment, the spring element 120 is inserted from an outside of the plug connector frame 110 through the side wall opening 117. In such an arrangement, no grooves 115*a*, 115*b* are necessary at the front face 112; instead, some grooves or a slot is disposed inside the side wall 116 for fixing the spring element 120.

Figure 3:
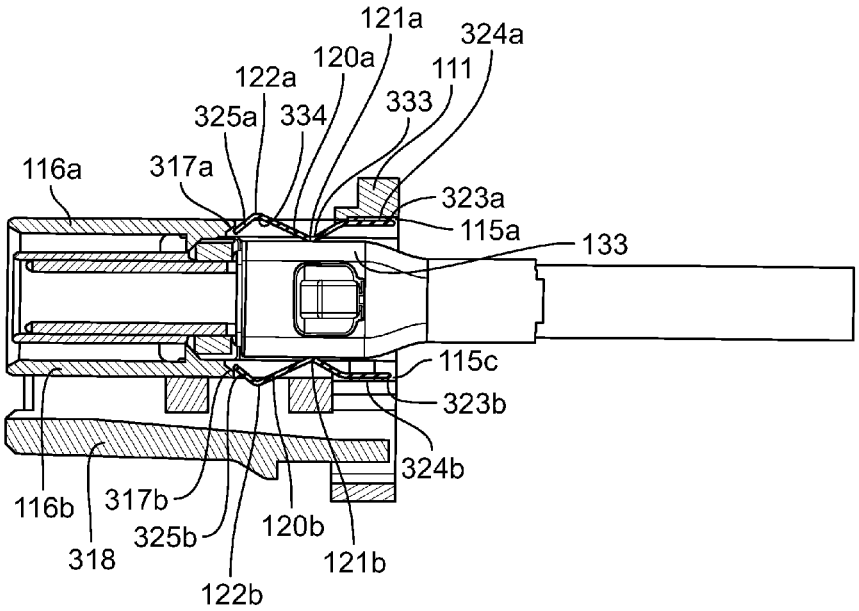
FIG. 3 is a sectional view of the plug connector and the cable head.

The spring element 120, shown in FIG. 1, is made of a resilient material and is partially or entirely formed out of an electrically conductive material. It has a first contacting portion 121 for electrically conductively contacting the cable head 130 and a second contacting portion 122 for electrically conductively contacting the socket 160. The portion of the spring element 120 connecting the first contacting portion 121 and the second contacting portion 122 is located at least partially inside the side wall opening 117 of the plug connector frame 110 and crosses the plane of the side wall 116 in the opening 117. The first contacting portion 121 extends inwards over the side wall 116 of the plug connector frame 110 and the second contacting portion 122 extends outwards over the side wall 116 of the plug connector frame 110 through the side wall opening 117, as also shown in FIG. 3. The second contacting portion 122 located closer to the front face 112, as shown in FIG. 1, protrudes from the plug connector 100 through the side wall 116 inwardly while the first contacting portion 121 located farther from the front face 112 protrudes from the plug connector 100 through the side wall 116 outwardly. In other embodiments, the second contacting portion 122 may protrude outwardly while the first contacting portion 121 may protrude inwardly.

Figure 2:
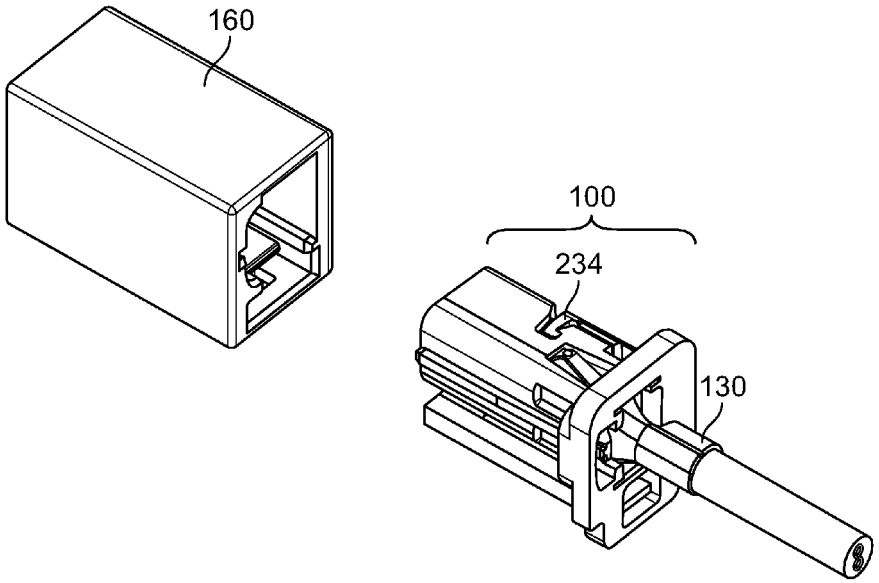
FIG. 2 is an exploded perspective view of a socket and a plug connector receiving a cable head of the plug connector system.

In use, the cable 131 with the cable head 130 is embedded in the plug connector 100 and the plug connector 100 is detachably plugged in the socket 160. FIG. 2 shows the socket 160 being detached from the plug connector 100 and the plug connector 100 receiving the cable head 130.

The attachment of the cable head 130 in the plug connector 100 is secured by a latch 234 shown in FIG. 2. In an embodiment, the latch 234 has the shape of a barbed hook cut into the plug connector frame 110 which engages a corresponding open space in a plug connector wall 116 after the cable head 130 has been inserted into the plug connector 100.

The cable head 130 is shown inserted into the plug connector 100 in FIG. 3. The plug connector 100 includes two spring elements 120*a* and 120*b* on two opposite side walls 116*a*, 116*b*. In other embodiments, the spring elements 120*a*, 120*b* may be arranged in a different manner, for example, four spring elements may be disposed on four side walls of the plug connector frame 110. In another embodiment with only one side wall 116, for example, a round side wall resembling the side wall of a cylinder, the spring elements 120*a*, 120*b* may be located on opposite portions of the single side wall 116. The spring element 120*a* is fitted into the side wall 116 of the plug connector frame 110. The spring element 120*a* is formed as a flat spring. The spring element 120*a* has two contacting portions 121*a* and 122*a*. The first contacting portion 121*a* projects inwards over the side wall 116 of the plug connector frame 110. The second contacting portion 121*b* projects outwards over the side wall of the plug connector frame 110. As the plug connector 100 accommodates the cable head 130, the first contacting portion 121*a* electrically contacts the crimp section 133 of the cable head 130. The first contacting portion 121*a* is located on a first bend 333 of the spring element 120*a* and the second contacting portion 122*a* is located on a second bend 334 of the spring element 120*a*. The spring element 120 provides, in the plugged state shown in FIG. 3, an interconnection between the socket shielding and the cable shielding; the spring element 120 may have any form known to those with ordinary skill in the art that serves this purpose.

The first contacting portion 121*a* and the second contacting portion 121*b* of the spring elements 120*a*, 120*b* are directly and electrically conductively connected. In particular, there is no loop or winding between the first contacting portion 121*a* and the second contacting portion 121*b*. As there is no loop or winding, the presence of unintended inductors is circumvented, which may otherwise deteriorate EMC. The direct connection between the first contacting portion 121*a* and the second contacting portion 121*b* in FIG. 3 is formed along a straight line. However, provided that there are no loops or windings, the direct connection between the first contacting portion 121*a* and the second contacting portion 121*b* may deviate from a straight line in other embodiments and may, for instance, be bent or slightly curved. In addition, due to the force exerted by the crimp section 133 on the spring element 120*a*, the spring element 120*a* may be deformed.

The spring element 120*a*, as shown in FIG. 3, has a flat end portion 323*a* fitted into the front portion 111 of the plug connector frame. The flat end portion 323*a* is in the form of a plate, an in the shown embodiment, a rectangular plate. The width of the flat end portion 323*a* corresponds to the width of the front gap 114. The shape of the flat end portion 323*a* may vary, and in other embodiments, may be a trapezoidal plate. By the flat end portion 323*a*, the spring element 120*a* is fitted into the front gap 114 of the plug connector frame 110. However, a spring element 120*a* according to an embodiment of the present invention may alternatively have no distinct flat end portion 323*a* and may be simply fitted by its flat end into the connector frame 110 either in the front portion 111 or in a side wall 116.

The faces of the flat end portion 323*a*, as shown in FIG. 3, are oriented substantially parallel to the side wall 116*a* of the plug connector frame 110. At its rim, the flat end portion 323*a* is fitted into the groove 115*a* of the plug connector frame 110. A protrusion 324*a* projects from the flat end portion 323*a* of the spring element 120*a* and enables thereby fitting the spring element 120*a* into the plug connector frame 110. The protrusion 324*a* allows the spring element 120*a* to be tightly fitted. In an embodiment, the protrusion 324*a* is a bulge extending from the flat end portion 323*a* of the spring element 120*a*. The spring element 120*a* is fixed in the plug connector frame 110 and the width of the groove 115*a* exceeds the thickness of the spring element 120*a*; the protrusion 324*a* fixes the end portion 323*a* and thus the entire spring element 120 within the plug connector. The groove 115*a* exceeds the thickness of the spring element 120*a* because tools for engraving thicker grooves are more robust, enabling a more cost and time efficient production.

A narrow end portion 325*a* of the spring element 120*a* opposite the flat end portion 323 abuts an edge 317*a* of the side wall opening 117. The edge 371*a* of the side wall opening 117 is opposite the end of the side wall opening 117 where the side wall opening 117 and the front gap 114 are joined. The edge 317*a* of the side wall opening 117 is inclined inwardly. This inward inclination restricts movement of the spring element 120*a*.

The plug connector 100, as shown in FIG. 3, comprises a second spring element 120*b*. The second spring element 120*b* is fitted into a second side wall 116*b* which is different from the first side wall 116*a* into which the first spring element 120*a* is fitted. The second side wall 116*b* is a side wall opposite the first side wall 116*a* into which the first spring element 120*a* is fitted. The first side wall 116*a* is an outer side wall of the plug connector frame 110 and, by contrast, the second side wall 116*b* is not an outer side wall of the plug connector frame 110 but is covered by a further outer side wall 318. The first spring element 120*a* and the second spring elements 120*b* are symmetrically arranged around the cable head 130, causing the electromagnetic field of a current being carried by the cable head 130 to be symmetric. In other embodiments, for the enforcement of a symmetric electromagnetic field, the number of spring elements 120 is two or a multiple of two, wherein at least one pair of spring elements 120 is symmetrically arranged around the cable head 130. In correspondence to the first spring element 120*a*, the second spring element 120*b* includes a first contacting portion 121*b*, a second contacting portion 122*b*, and a flat end portion 323*b* from the flat surface of which a protrusion 324*b* projects. Its narrow end portion 325*b* is tangent to the edge 317*b* of the opening of the second side wall 116*b*. Thus, the second spring element 120*b* is stopped from further movement within the plug connector frame 110 by abutting the edge 317*b*. The above description of the first spring element 120*a* and its features analogously applies to the second spring element 120*b*.

Figure 4:
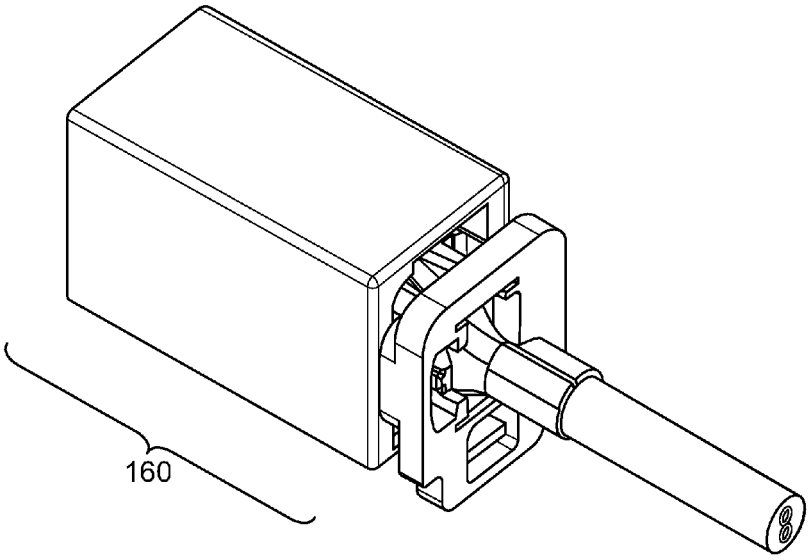
FIG. 4 is a perspective view of the plug connector system.
Figure 5:
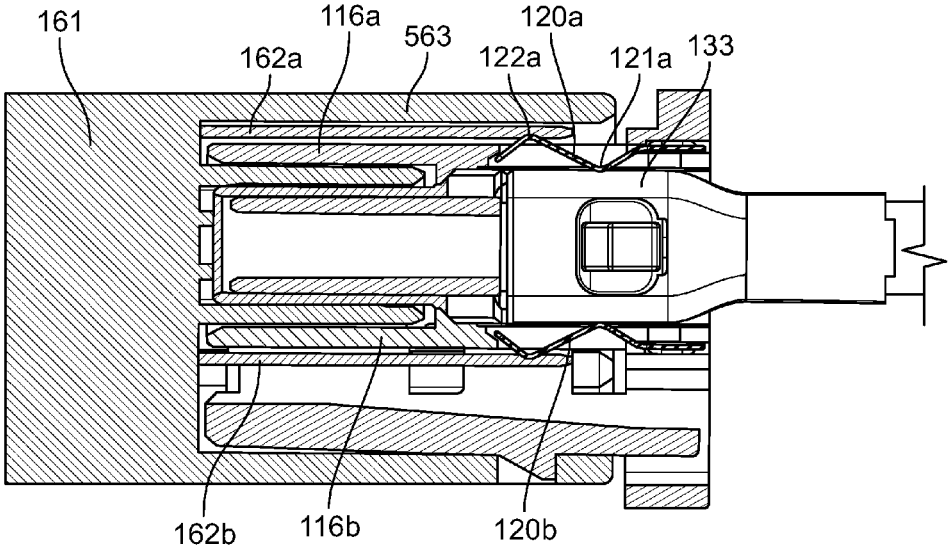
FIG. 5 is a side sectional view of the plug connector system.

In the FIGS. 2 and 3, the plug connector frame 110 accommodates the cable head 130, but it is detached from the socket. In FIGS. 4 and 5, the plug connector 100 accommodates the cable head 130 and it is further inserted into the socket 160 to form the plug connector system.

As shown in FIG. 4, the socket 160 has the shape of a cuboid with a front, a back, and four side walls. The front and the back are square shaped. Two side walls not located opposite of each other may have the same dimensions or may have different dimensions.

As shown in FIG. 5, the socket 160 comprises a socket body 161 and a plate 162*a*. The plate 162*a* is made of an electrically conductive material. The plate 162*a* is parallel to a socket wall 563. The first contacting portion 121*a* conductively contacts the crimp section 133 of the cable head 130. In addition, the second contacting portion 122*a* conductively contacts the plate 162*a* of the socket 160. The first contacting portion 121*a* and the second contacting portion 121*b* are directly and conductively connected. Due to the forces exerted on the spring element 120*a* by the crimp section 133 and the plate 162*a*, the spring element 120*a* may be slightly deformed. Thus, the direct connection between the first contacting portion 121*a* and the second contacting portion 122*a* may deviate from a straight line.

As shown in FIG. 5, the plug connector 100 includes a second spring element 120*b* fitted into the second side wall 116*b* and the socket 160 includes a second plate 162*b* which conductively contacts the second contacting portion 122*b*. The first plate 162*a* and the second plate 162*b* are located on opposite walls of the socket 160. Both the first spring element 120*a* and the second spring element 120*b*, and the first plate 162*a* and the second plate 162*b*, are symmetrically arranged around the cable head 130, causing the electromagnetic field of a current being carried by the cable head 130 to be symmetric.

Figure 6:
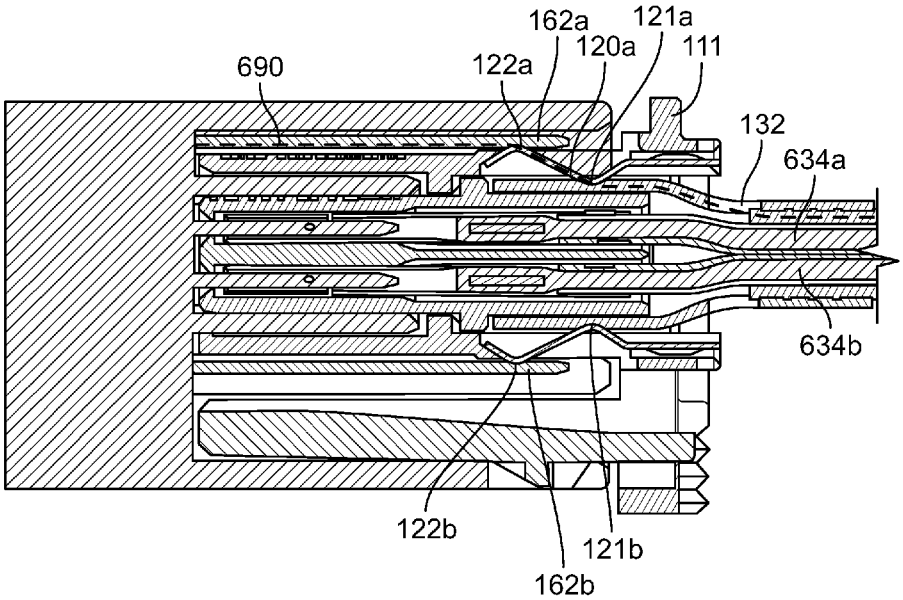
FIG. 6 is another side sectional view of the plug connector system.
Figure 7:
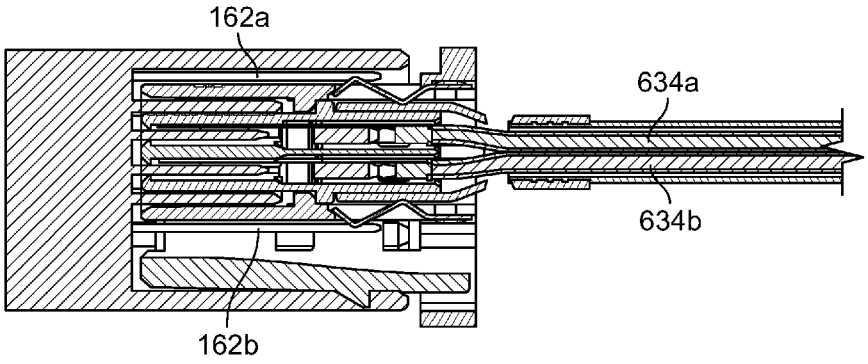
FIG. 7 is another side sectional view of the plug connector system.
Figure 8:
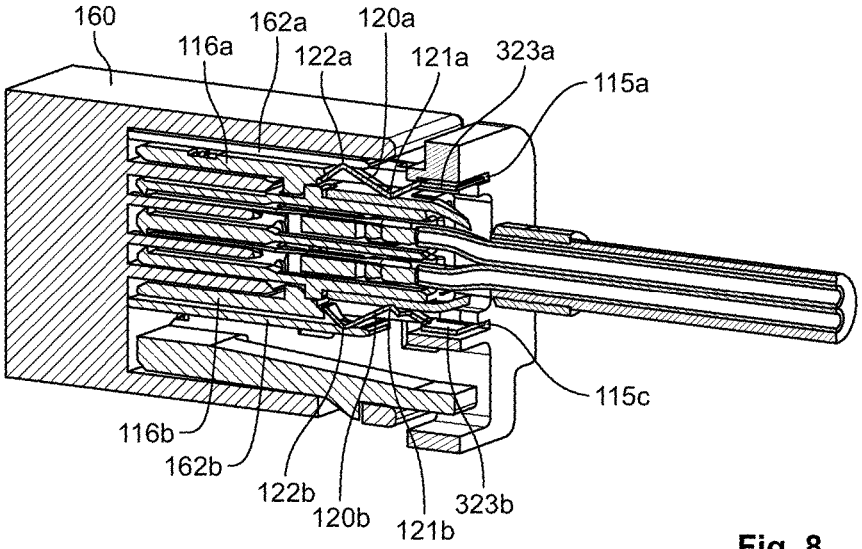
FIG. 8 is a perspective sectional view of the plug connector system.

FIG. 6-8 show cross-sections of the plug connector system. A plurality of current carriers 634*a*, 634*b* or wires inside the cable 131 and the cable head 130 are shown. In an embodiment, the socket 160 is used to accommodate a plug connector frame 110 for a shielded cable, in particular in STP cable. However, an identical socket 160 can be used in a connector system of an unshielded cable such as a UTP cable. In connector systems for unshielded cables, symmetrical plates are intended to ensure low mode conversion. By using two symmetrical plates 162*a*, 162*b* rather than one single plate, the build-up of an electric field between current carriers inside the cable head 130 and the single metal plate is prevented. Accordingly, current carriers and the single conductive plate are prevented from unintentionally forming a capacitor.

As shown in FIG. 6, the first contacting portions 121*a*, 121*b* of both spring elements 120*a*, 120*b* for contacting the cable head 130 are located closer to the front portion 111 of the plug connector frame 110 than the second contacting portions 122*a*, 122*b*. However, in an alternative embodiment, at least one of the spring elements 120*a*, 120*b* may be fitted into the spring element upside down so that the contacting portion 122*a* farther from the front portion 111 serves as the first contacting portion for contacting the cable head 130. In this case, longer contact plates 162*a*, 162*b* are required than shown in FIG. 6.

When the socket 160 is used for an STP cable, as in an embodiment of the present invention, the symmetrical and parallel plates 162*a*, 162*b* further serve as shielding elements of the socket 160. The plates 162*a*, 162*b* shield the electromagnetic field resulting from a current inside the cable head 130. Accordingly, the fixation element 132 with the crimp section 133 serves as a shielding element of the cable head 130. The spring element 120*a* conductively connects the shielding element of the socket 160 with the shielding element of the cable head 130. A dash-dotted line 690 shown in FIG. 6 symbolizes the path of the current running from the plate 162*a* of the socket 160 through the spring element 120*a* to the fixation element 312 of the cable head 130.

Through conductively connecting the shielding elements of socket 160 and cable head 130, the spring element 120*a* causes the shielding elements of the socket 160 and the cable head 130 to have the same electrical potential. As a consequence, electrical fields due to a difference in electrical potential between the shielding elements of socket 160 and cable head 130 are prevented from emanating from the plug connector. Therefore, a plug connector 100 having a spring element 120*a* for electrically conductively connecting a socket 160 and a cable head 130 enhances EMC of a plug connector system. The number of plates 162 is not limited to two. In other embodiments there may be, for example, four plates on the four side walls of the socket 160.

In FIG. 8, as in FIG. 5, the plug connector 100 has two spring elements 120*a*, 120*b* fitted into plug side walls 116*a*, 116*b*, and the socket 160 has two plates 162*a*, 162*b*. The spring elements 120*a*, 120*b* are fitted into the side walls 116*a*, 116*b* of the plug connector frame 110. The first contacting portions 121*a*, 121*b*, of the spring element 120*a*, 120*b*, contacting the crimp section 133 of the cable head 130, are directly connected to the second contacting portions 122*a*, 122*b* contacting the plates 162*a*, 162*b* of the socket 160. The crimp section 133 of the cable head 130 and the plates 162*a*, 162*b* of the socket 160 exert forces on the spring elements 120*a*, 120*b*, elastically deforming the spring elements 120*a*, 120*b*. These forces prevent the spring elements 120*a*, 120*b* from losing the conductive contact with the plates 162*a*, 162*b* and the crimp section 133. The edges of the flat end portions 323*a*, 323*b* of the spring elements 120*a*, 120*b* are fitted into the grooves 115*a*, 115*c* for inserting the spring elements into the plug connector frame 120*a*, 120*b*

Figure 9:
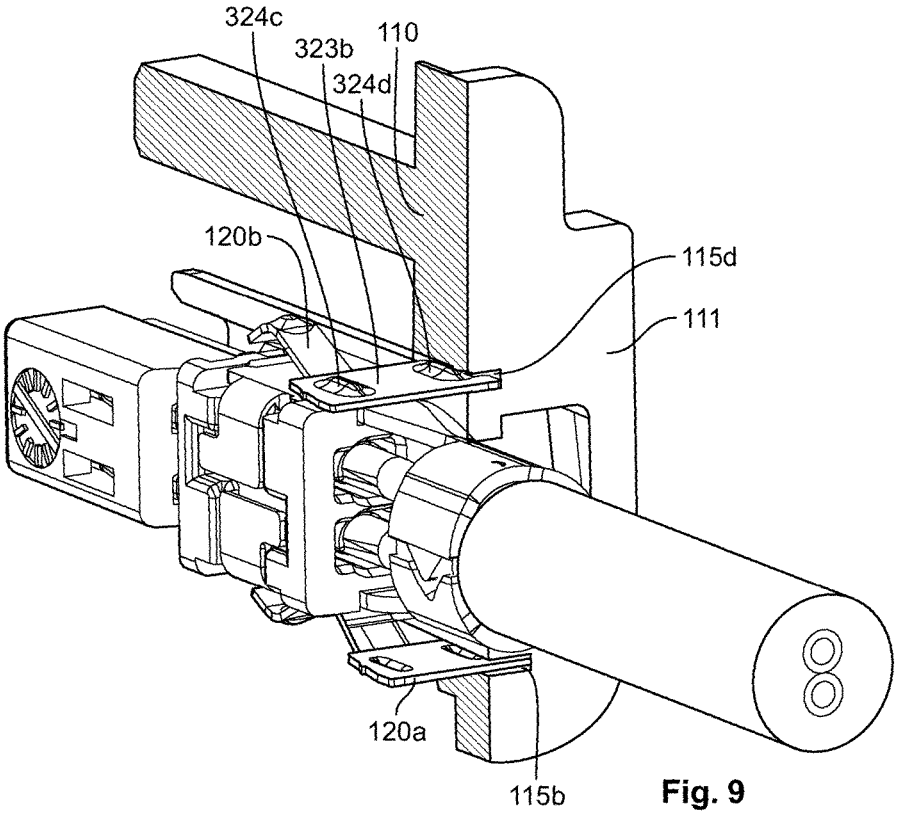
FIG. 9 is another perspective sectional view of the plug connector system.

The groove 115*d* into which the edge of the flat end portion 323*b* of the spring element 120*b* is inserted is shown in FIG. 9. Protrusions 324*c*, 324*d* project from the flat end portion 323*b* of the spring element 120*b*. The protrusions 324*c*, 324*d* are bulges extending from the flat end portion 323*b* of the spring element 120*b*. Having a protrusion 324, the flat end portion 323 fills the gap 114 in the front portion 111 defined by the groove 115*d* of the plug connector frame although the width of gap 114 exceeds the thickness of the flat end portion 323*b* of the spring element 120*b*.

Figure 10:
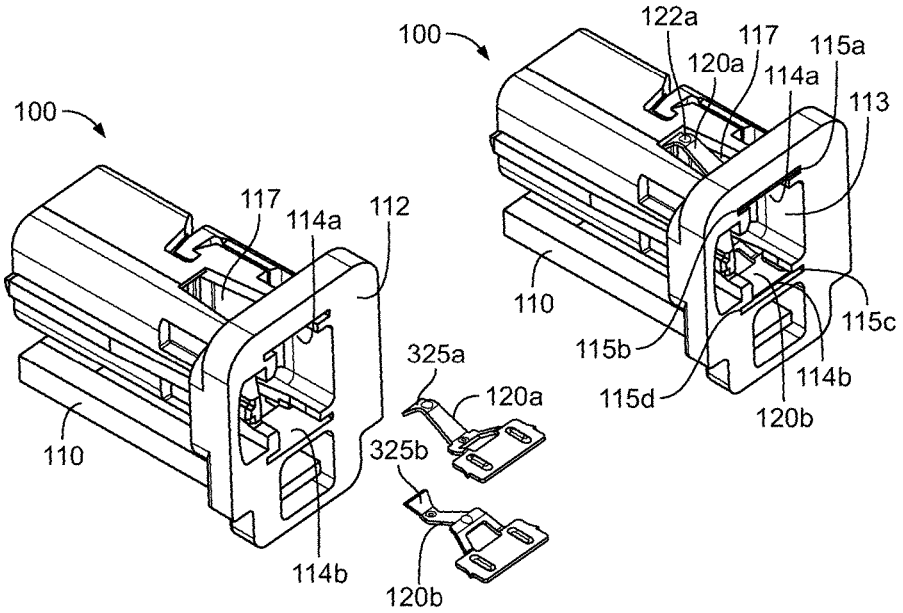
FIG. 10 is a perspective view of a plug connector frame and spring elements of the plug connector.

The plug connector frame 110 and the spring elements 120*a* and 120*b* are shown in FIG. 10. The spring elements 120*a*, 120*b* face the front face 112 of the plug connector frame 110 with the openings 114*a*, 114*b* for inserting the spring elements 120*a*, 120*b*. The spring elements 120*a* and 120*b* are arranged symmetrically with respect to each other; the first contacting portions 121*a*, 121*b* of the two spring elements point towards each other, and the second contacting portions 122*a*, 122*b* of the two spring elements point away from each other. The narrow end portions 325*a*, 325*b* are oriented towards the front face 112 of the plug connector frame 110. This relative arrangement of the spring elements 120*a*, 120*b* with respect to each other and with respect to the plug connector frame 110 is in accordance with the assembly of the plug connector 100, wherein the narrow end portions 325*a*, 325*b* face the front face 112 of the plug connector frame 110 when spring elements 120*a*, 120*b* are inserted into the front gaps 114*a*, 114*b* of the plug connector frame 110.

The subfigure on the right hand side of FIG. 10 shows the plug connector 100 after the spring elements 120*a*, 120*b* have been inserted into the plug connector frame 110. One spring element 120*a* is fitted into the side wall 116*a* of the plug connector frame 110. The second contacting portion 122*a* emerges over the side wall 116*a* of the plug connector frame 110 through the side wall opening 117. The gaps 114*a*, 114*b* for inserting the spring elements have the shape of grooves 115*a*, 115*b*, 115*c*, 115*d* embedded into the front portion 111. In an embodiment, the gaps 114*a*, 114*b* are joined with the front opening 113 for inserting the cable head 130. Alternatively, gaps for inserting the spring elements 120*a*, 120*b* can have the shape of slots which are not joined with a front opening for inserting the cable head. From the front portion 111 of the plug connector frame 110 to the middle of the side wall, the side wall opening 117 tapers; the side wall opening 117 has the shape of the trapezium, wherein the side joining the front portion 111 of the plug connector frame 110 is longer than its opposite parallel side. The taper and the trapezoidal shape of the side wall opening 117 allow thicker walls in comparison with a rectangular side wall opening.

Figure 11:
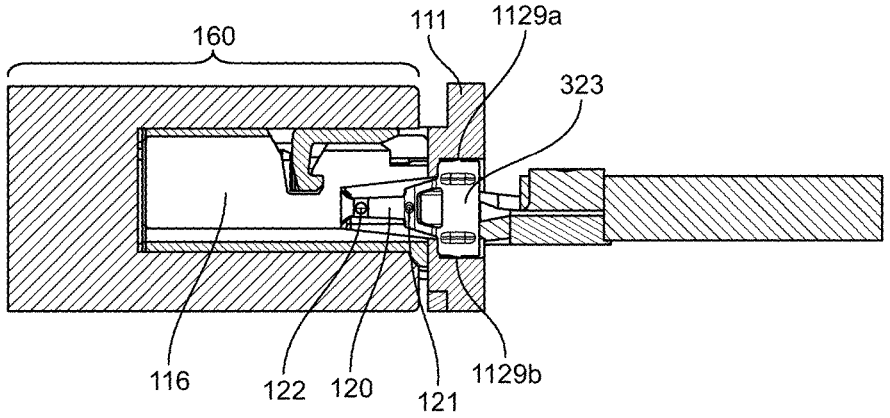
FIG. 11 is a sectional view of the plug connector system.

The plug connector 100 is shown accommodating the cable head 130 and being inserted into the socket 160 in FIG. 11. The spring element 120 is fitted into the side wall 116 of the plug connector frame 110. In the cross-section of the plug connector system shown in FIG. 5, the side wall 116*a* into which the spring element 120*a* is fitted is perpendicular to the plane corresponding to the paper/screen. In contrast, in FIG. 11, the side wall 116 into which the spring element 120 is fitted, is parallel to the plane corresponding to the paper/screen. At opposite sides of the flat end portion 323 of the spring element 120, teeth 1129*a*, 1129*b* protrude from the rim of the flat end portion 323. The teeth 1129*a*, 1129*b* are pressed into the material of the plug connector frame 110 for a strong fixation of the spring element 120 to the plug connector frame 110. The portion of the spring element 120 comprising the first contacting portion 121 and the second contacting portion 122 is located inside the side wall opening 117.

The spring element 120 is shown in FIGS. 12-15. In an embodiment, the spring element 120 is made of a conductive and resilient material, such as metal. The spring element 120 may be made of stainless steel, such as X10CrNi18-8, to meet the requirement of resilience, although the electrical conductivity of steel may be limited. To compensate for the limited conductivity of the spring element material and/or to improve the electrical conductivity at the contacting portions, the first contacting portion 121, the second contacting portion 122, and/or the spring element portion between the first contacting portion may be plated with a material having a greater conductivity than the spring element material. The plating at the contacting portions 121, 122 may be, for example, a tin plating, a gold plating, or a nickel plating. If a sufficient conductivity between the first contacting portion 121, the second contacting portion 122, and on the two contacting portions is secured through the plating, the spring element 120 may be made of a dielectric or a material with a low conductance, such as a non-metal.

Figure 12:
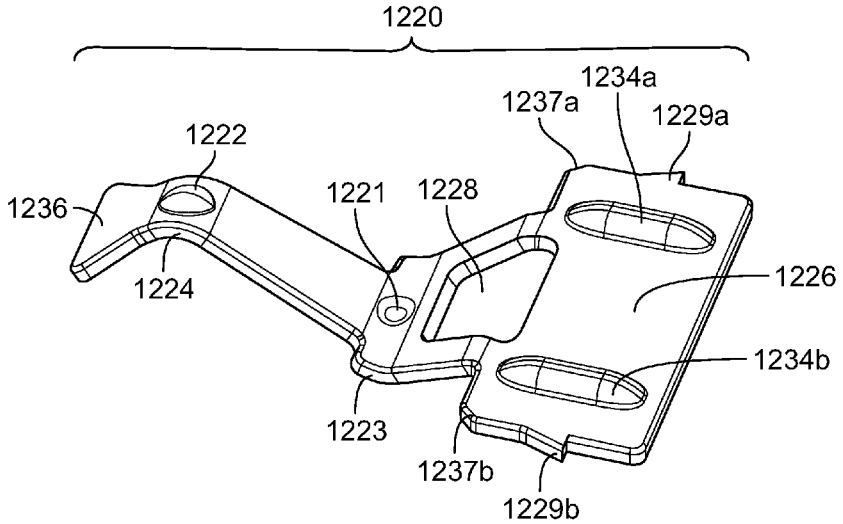
FIG. 12 is a perspective view of a spring element.
Figure 13:
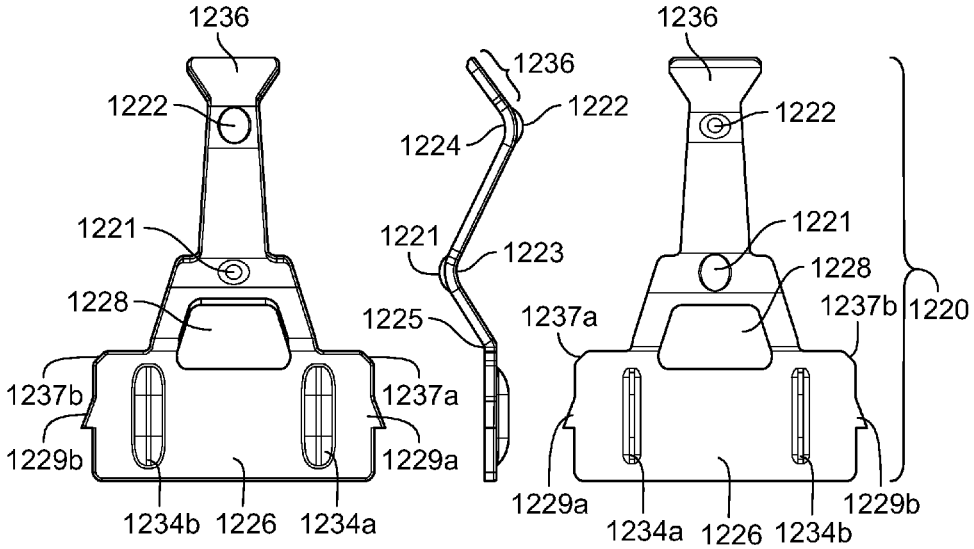
FIG. 13 is a top, side, and bottom view of the spring element of FIG. 12.

An embodiment of a spring element 1220 is shown in FIGS. 12 and 13. The spring element 1220 is made of a single piece of a conductive and resilient material. It is formed as a flat spring having a first bend 1223 and a second bend 1224 oriented in opposite directions. At the bends, there are protrusions projecting from the spring element 1220. These protrusions are formed as round or oval bulges stamped into the spring element 1220 at the bends 1223, 1224. The bulges constitute the first contacting portion 1221 and the second contacting portion 1222 of the spring element 1220. When the spring element 1220 is fitted into the wall of a plug connector frame 110, the bulge constituting the first contacting portion 1221 is oriented to the interior of the plug connector frame 110, and the bulge constituting the second contacting portion 1222 is oriented to the exterior of the plug connector frame 110. Through these bulges, the first contacting portion 1221 and the second contacting portion 1222 are formed as point contacts. Such localized contacts allow a well-defined, tight and secure contact of the spring element 1220 with the cable head 130 and the socket 160, respectively. In other embodiments, the protrusions may have the shapes of cones. Furthermore, different protrusions may project from the opposite surfaces of the plug connector frame 110; instead of being stamped into the spring element material, they may be soldered onto the spring element material, or formed in any other way.

The spring element 1220 further comprises, as shown in FIGS. 12 and 13, a flat end portion 1226 for being fitted into the plug connector frame 110 at the front portion of the plug connector frame 110. There is a third bend 1225 between the flat end portion 1226 and the remaining portion of the spring element. The flat end portion 1226 is broader than the remaining portion of the spring element 1220. The flat end portion 1226 has a form of a plate, in particular, a rectangular plate. From one surface of the flat end portion 1226, protrusions 1234*a*, 1234*b* project. The two protrusions 1234*a*, 1234*b* are bulges having a prolate shape stamped into the flat end portion 1226 of the spring element 1220. When the spring element 1220 is fitted into the plug connector frame 110, the protrusions 1234*a*, 1234*b* reduce the transversal movement of the spring element 1220. Alternatively, there may be other arrangements of protrusions, such as, for example, one single bulge in the center of the flat end portion 1226, or four round bulges instead of two prolate bulges. Protrusions may further protrude from both opposite surfaces of the plug connector frame 110. On each of the longitudinal sides of the spring element 1220, a tooth 1229*a*, and respectively, 1229*b* protrudes from the rim of the flat end portion 1226, for being at least partially pressed into the material of the plug connector frame 110. The teeth 1229*a*, 1229*b* serve for fixing the spring element 1220 in the plug connector frame 110. In addition, the flat end portion 1226 includes guiding features 1237*a*, 1237*b* at the corners of the side which is first inserted into the plug connector frame 110.

The guiding features 1237*a*, 1237*b* facilitate the insertion of the spring element 1220 into the plug connector frame 110. The guiding features 1237*a*, 1237*b* have the shape of inclinations of the flat end portion 1226 at the corners on the side which is first inserted into the plug connector frame 110. However, the shape of the guiding features 1237*a*, 1237*b* may differ. The guiding features 1237*a*, 1237*b* may, for example, be formed as rounded corners. Furthermore, the spring element 1220 has an opening 1228 between the flat end portion 1226 and the first contacting portion 1221 for controlling the stresses and forces being exerted on the spring element 1220, for example, when inserting the spring element 1220 into the plug connector frame 110. From the first contacting portion 1221 to the second contacting portion 1222, the spring element 1220 tapers in order to reduce forces and mechanical stresses being exerted on the spring element 1220. From the second contacting portion 1222 at the second bend 1224 to the narrow end portion 1236, the spring element 1220 gets wider again. This widening secures a tight engagement of the spring element 1220 to the side wall of the plug connector frame and reduces the movement of the narrow end of the spring element 1220. However, the invention is not limited to this particular design. In other embodiments, instead of a taper between the first contacting portion 1221 and the second contacting portion 1222 and a widening between the second contacting portion 1222 and the narrow end portion 1236, the opposite longitudinal rims of the spring element 1220 may be parallel.

Figure 14:
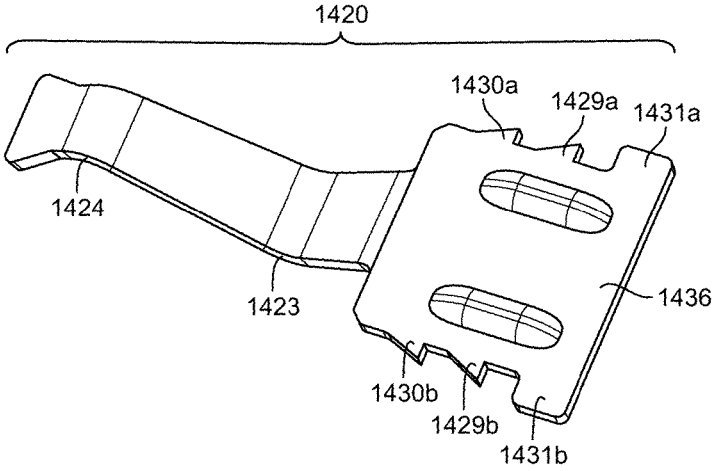
FIG. 14 is a perspective view of another spring element.
Figure 15:
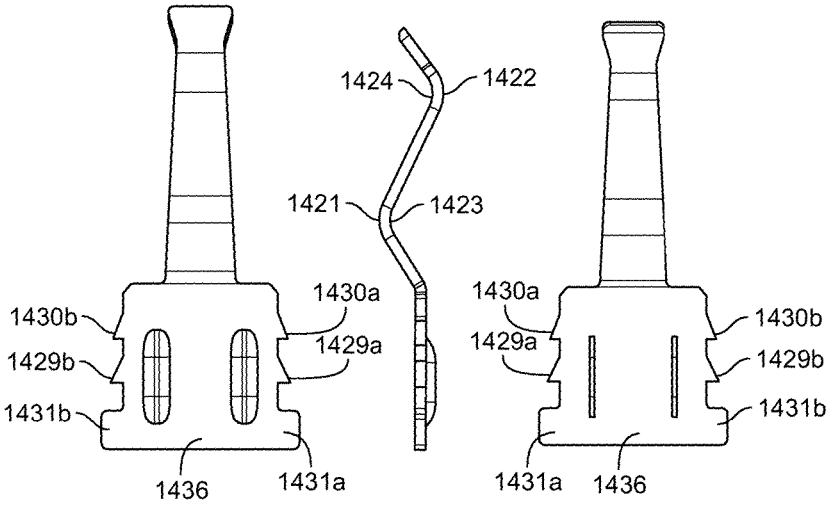
FIG. 15 is a top, side, and bottom view of the spring element of FIG. 14.

A spring element 1420 according to another embodiment of the invention is shown in FIGS. 14 and 15. Like the spring element 1220 shown in the FIGS. 12 and 13, the spring element 1420 is made of a single piece of a conductive and resilient material. Also, it is formed as a flat spring having a first bend 1423 and a second bend 1424 pointing to opposite directions. In contrast to the spring element 1220 shown in the FIGS. 12 and 13, spring element 1420 has no protrusions projecting from the bends. Therefore, the first contacting portion 1421 and the second contacting portion 1422 are formed as line contacts running along the first bend 1423 and the second bend 1424. Contacting portions formed as bulges secure a localized, precise and reliable contact of the spring element 1420 with the shielding elements of the socket 160 and the cable head 130. On the other hand, without protrusions such as bulges for contacting portions, the production of the spring element 1420 may be facilitated as a production step is omitted.

Like the spring element 1220 shown in the FIGS. 12 and 13, the spring element 1420 has a flat end portion 1426. There is a third bend between the flat end portion 1433 and the remainder of the spring element 1420. However, in contrast to the spring element 1220 shown in the FIGS. 12 and 13, there is no opening between the flat end portion 1426 and the first contacting portion 1422. On each of the longitudinal sides of the spring element 1420, there is a pair of teeth 1229*a*, 1230*a*, and respectively, 1229*a*, 1230*b* protruding from the rim of the flat end portion 1226, and additionally, a rectangular protrusion 1431*a*, and 1431*b*, for being at least partially pressed into the material of the plug connector frame 110. There may be other arrangements of protrusions on the rim of the flat end portion, for example two rectangular protrusions on each side instead of one rectangular protrusion and two teeth.

The present invention is not limited to the spring elements 1220, 1420 shown in the FIGS. 12-15. Features of the different types of spring elements 1220, 1420 shown therein may be combined. A spring element 1220, 1420 made of one piece is robust and can be easily and feasibly produced. However, the spring element 1220, 1420 need not necessarily be made of one piece of the conductive and resilient material as, for instance, the flat end portion and the remaining portion of the spring element 1220, 1420 may be welded together. Furthermore, the spring element 1220, 1420 may consist of two parts made of different materials being attached to each other, for example, by gluing or welding them together.

Figure 16:
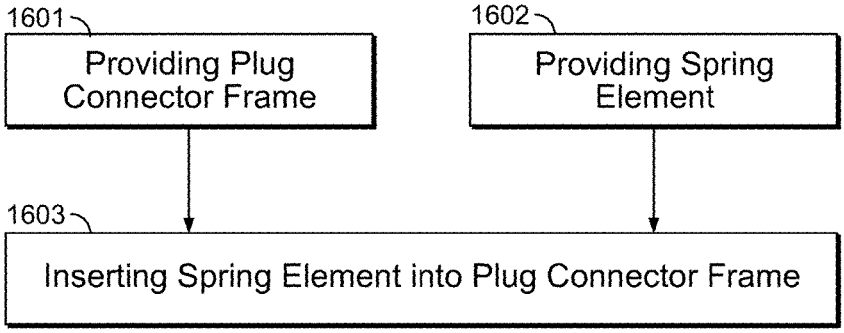
FIG. 16 is a schematic of a method for manufacturing a plug connector.

A method for manufacturing a plug connector 100 according to the invention is shown in FIG. 16. The method comprises the method step 1601 of providing a plug connector frame 110. The plug connector frame 110 has a front opening 113 for accommodating a cable head 130, a gap 114 for inserting a spring element 120, and a side wall 116. Furthermore, the method comprises the method step 1602 of providing a spring element 120 made of a resilient material for electrically conductively connecting the cable head 130 and the socket 160. The spring element 120 has a first contacting portion 121 for conductively contacting the cable head 130 and the second contacting portion 122 for conductively contacting the socket 160. Furthermore, the first contacting portion 121 and the second contacting portion 122 point into opposite directions and are directly and conductively connected. The method further comprises the step 1603 of inserting the spring element 120 into the plug connector frame 110 through the gap 114, wherein the spring element 120 is elastically deformed. As a result of the insertion, the first contacting portion 121 emerges inwards over the side wall 116 of the plug connector frame 110 and the second contacting portion 122 emerges outwards over the side wall 116 of the plug connector frame 110.

Figure 17:
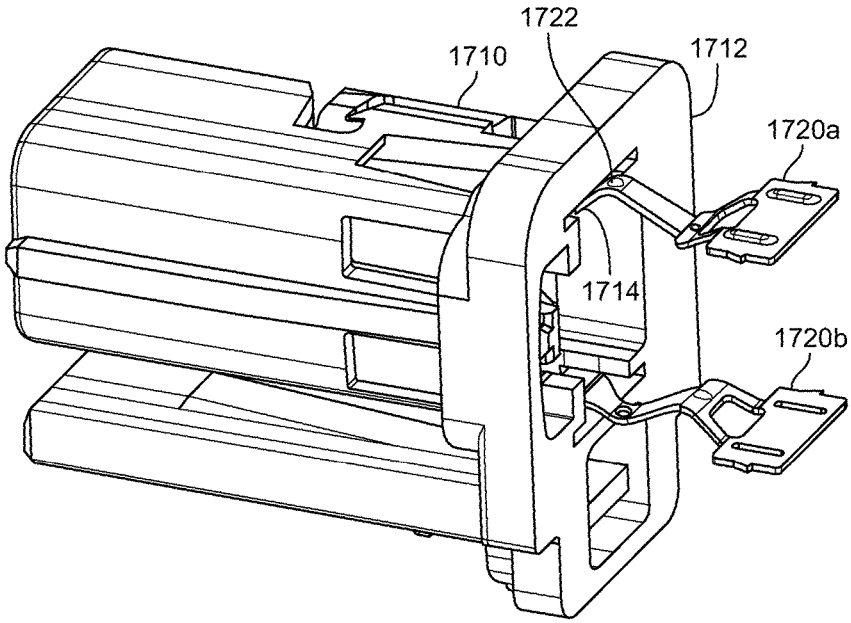
FIG. 17 is a perspective view of a plug connector frame and a plurality of spring elements.

The method of inserting the spring element 120 into the plug connector frame 110 is shown in FIG. 17. FIG. 17 shows a spring element 1720*a* which has been partially inserted into the plug connector frame 1710 through the front gap 1714 in the front face 1712. When the second contacting portion 1722 of the spring element 1720 passes the front gap 1714 and moves into the plug connector frame 1710, a force is exerted on the spring element 1720*a*, and the spring element 1720*a* is reversibly deformed by mechanical stress resulting from the force. The spring element 1720*a* is formed to be able to bear enough deflection for passing of the front gap 1714, while the deflection of the spring element 1720 during the insertion is linear and elastic; the spring element 1720 is not subject to permanent, deformation, i.e. plastic deformation. The elastic deflection of the spring element 1720 and the avoidance of plastic deformation are secured through the forming of the spring element 1720*a* and through the choice of a resilient material. Analogously to the insertion of spring element 1720*a* into the plug connector frame, a second spring element 1720*b* has been partially inserted into the plug connector frame.

A plug connector 100 resulting from the manufacturing method described above with reference to the FIGS. 14 and 15 is suitable for use in the assembly of a plug connector system comprising the plug connector 100, a cable head 130, and a socket 160. By comprising a spring element 120 for connecting the shielding element of the socket 160 and the shielding element of a cable head 130, the plug connector 100 is suitable for use with a shielded cable such as an STP cable. However, a similar plug connector 100 can be used when connecting an unshielded cable, such as a UTP cable, to a socket 160. In the case of an unshielded cable, the same type of plug connector frame 110 can be used without spring 120. In addition, the socket 160 used in the plug connector system can be used for an unshielded cable as well. The use of a socket 160 that is equal in the cases of an unshielded and a shielded cable and plug connectors 100 that are similar for the two cases allow an economic and flexible assembly. On the one hand, shielded cables and unshielded cables may be combined in an economic way. On the other hand, it may still be decided at a late stage of assembly whether an unshielded cable or a shielded cable is preferred for a particular application.

Figure 18:
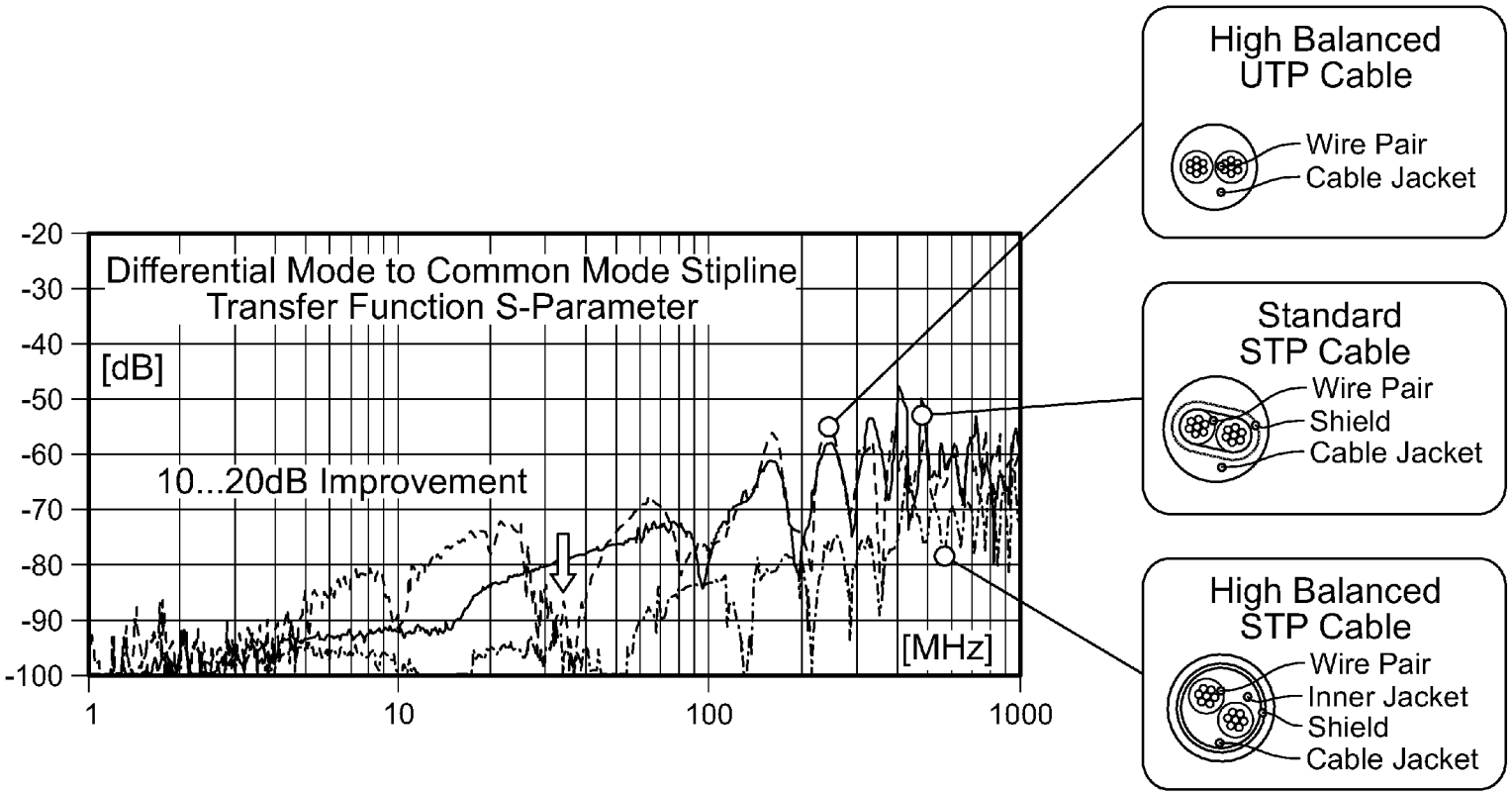
FIG. 18 is a graph of test results of an EMC performance test for shielded and unshielded cables in the plug connector system.

The plug connector system according to the invention has been used as a demonstrator system for a comparison of the EMC performance of a high balanced UTP cable, a standard STP cable, and a high balanced STP cable. Cross sections of the three different cables are illustrated on the right hand side of FIG. 18. The high balanced STP cable differs from the standard STP cable by an inner jacket embedding the wires. The high balanced UTP cable used in the test fulfills the mode conversion requirements for automotive single pair unshielded 1 Gbit/s applications. A stripline test setup was used for measuring the EMC performance. The twisted pair cable was stimulated with the differential signal (i.e., the signaling mode used for data communication). The common mode signal at the stripline versus ground (i.e., the noise signal) was measured at the output. The transfer of function between the data mode and noise mode was calculated by a vector and network analyzer (VNA). The resulting S-parameter in dB is the value for assessment of the EMC capability. The test results are shown in FIG. 18. The S-parameter in dB is shown as a function of the differential signal in MHz. The results illustrate that the standard STP cable shows a lower performance for certain frequency ranges, as indicated by the arrow. High balanced shielded, cables, on the other hand, provide an improvement of about 10 to 20 dB.

What is claimed is:

1. A plug connector for insertion into a socket, comprising:

a plug connector frame having a side wall and a front opening receiving a cable head; and a spring element formed of a resilient material electrically connecting the cable head and the socket, the spring element having a first contacting portion projecting inward from the side wall and electrically contacting the cable head, a second contacting portion projecting outward from the side wall and electrically contacting the socket, and a flat end portion fitted into a portion of the plug connector frame adjacent a front face including the front opening.

2. The plug connector of claim 1, wherein the first contacting portion and the second contacting portion are directly connected mechanically and are electrically connected.

3. The plug connector of claim 1, wherein the spring element is a flat spring having a pair of bends.

4. The plug connector of claim 3, wherein the bends are oriented in opposite directions and the first contacting portion and second contacting portion are disposed at the bends.

5. The plug connector of claim 4, wherein the first contacting portion and the second contacting portion are each a protrusion.

6. The plug connector of claim 1, wherein the spring element has a protrusion projecting from a surface of the flat end portion and fixing the spring element in the plug connector frame.

7. The plug connector of claim 6, wherein the protrusion is stamped into the flat end portion of the spring element.

8. The plug connector of claim 6, the spring element has a tooth protruding from a rim of the flat end portion.

9. The plug connector of claim 8, wherein the tooth fixes the spring element in the plug connector frame by at least partially pressing into a material of the plug connector frame.

10. The plug connector of claim 1, wherein the spring element is formed from a single piece of the resilient material.

11. The plug connector of claim 1, wherein the resilient material is a metal.

12. The plug connector of claim 1, wherein the first contacting portion and the second contacting portion are plated with a plating material having a higher electrical conductivity than the resilient material.

13. The plug connector of claim 1, wherein the plug connector frame has a front gap receiving the spring element.

14. The plug connector of claim 13, wherein the front gap and the front opening of the plug connector frame are joined.

15. The plug connector of claim 13, wherein the first contacting portion and the second contacting portion emerge over the side wall through a side wall opening joined with the front gap.

16. The plug connector of claim 1, further comprising a second spring element fitted into a second side wall of the plug connector frame opposite the side wall into which the spring element is fitted.

17. A plug connector system, comprising:

a socket having a first shielding element made of an electrically conductive material;

a cable head of a shielded cable, the cable head having a second shielding element made of the electrically conductive material; and a plug connector detachably insertable into the socket, the plug connector including a plug connector frame having a side wall and a front opening receiving the cable head, and a spring element formed of a resilient material electrically connecting the first shielding element and the second shielding element, the spring element having a first contacting portion projecting inward from the side wall and electrically contacting the cable head, a second contacting portion projecting outward from the side wall and electrically contacting the socket, and a flat end portion fitted into a portion of the plug connector frame adjacent a front face including the front opening.

18. The plug connector system of claim 17, wherein the cable head is fixed in the plug connector.

19. A method for manufacturing a plug connector, comprising:

providing a plug connector frame having a side wall, a front opening receiving a cable head, and a front gap;

providing a spring element having a first contacting portion electrically contacting the cable head, a second contacting portion electrically contacting the socket, and a flat end portion, the first contacting portion and the second contacting portion projecting in opposite directions; and inserting the spring element into the plug connector frame through the front gap, the first contacting portion projecting inward from the side wall, the second contacting portion projecting outward from the side wall, and the flat end portion fitted into a portion of the plug connector frame adjacent a front face including the front opening, the spring element elastically deformed during insertion.

20. A plug connector for insertion into a socket, comprising:

a plug connector frame having a side wall, a front opening receiving a cable head, and a front gap; and a spring element formed of a resilient material electrically connecting the cable head and the socket, the spring element having a first contacting portion projecting inward from the side wall and electrically contacting the cable head and a second contacting portion projecting outward from the side wall and electrically contacting the socket, the spring element is received in the front gap and the first contacting portion and the second contacting portion emerge over the side wall through a side wall opening joined with the front gap.

21. A plug connector for insertion into a socket, comprising:

a plug connector frame having a side wall and a front opening receiving a cable head;

a spring element formed of a resilient material electrically connecting the cable head and the socket, the spring element having a first contacting portion projecting inward from the side wall and electrically contacting the cable head and a second contacting portion projecting outward from the side wall and electrically contacting the socket; and a second spring element fitted into a second side wall of the plug connector frame opposite the side wall into which the spring element is fitted.

* * * * *